US005190122A

United States Patent [19]

Fletcher et al.

[11] Patent Number: 5,190,122

[45] Date of Patent: Mar. 2, 1993

[54] SAFETY INTERLOCK SYSTEM

[75] Inventors: Robert H. Fletcher, Glenwood, N.J.; James Myers, Oakridge, Tenn.

[73] Assignee: Andvantage Lift Systems, Inc., San Diego, Calif.

[21] Appl. No.: 758,118

[22] Filed: Sep. 12, 1991

[51] Int. Cl.[5] ..... B66F 7/00

[52] U.S. Cl. ..... 187/8.5; 254/89 R; 74/519; 74/522.5

[58] Field of Search ..... 187/8.47, 8.49, 8.5, 187/8.57; 254/89 R, 89 H, 90, 91, 93 L, 2 B, 2 C, 10 R, 10 B, 10 C; 74/519, 522.5

[56] References Cited

U.S. PATENT DOCUMENTS 1,638,790 8/1927 Weaver ..... 254/2 B
1,758,262 5/1930 Mahoney ..... 254/93 L X
3,038,700 6/1962 Ascherl ..... 254/89 R X
3,195,860 7/1965 Simms ..... 254/2 B
5,012,898 5/1991 Tsymberov ..... 187/8.47

FOREIGN PATENT DOCUMENTS 783915 10/1957 United Kingdom .

*Primary Examiner*—Robert P. Olszewski
*Assistant Examiner*—Dean A. Reichard
*Attorney, Agent, or Firm*—Melvin K. Silverman

[57] ABSTRACT

A safety interlock system is provided for enabling ascend or descend interrupt of an automotive lift platform. A interface of negative rake sinusoidal shaped surfaces is employed together with an assembly for selectably placing such surfaces against each other during descent interrupt.

8 Claims, 6 Drawing Sheets

SAFETY INTERLOCK SYSTEM

BACKGROUND OF THE INVENTION

In the prior art of lifting devices, a persistent problem has been that of locking of the elevated elements thereof in response to a system failure during ascent or descent of the system.

In the prior art, as is reflected in U.S. Pat. No. 3,117,765 (1964) to Chiuzzi entitled Lifting Device, the standard approach to so-called locking plate or safety interlocks is that of employment of sawtooth or serrated complementally interlocking teeth such that, as the members of the lifting system are elevated, such serrated teeth will slide over each other, and will rest slightly above each other during normal descent.

A shortcoming with the structures of the prior art is that in those instances where the teeth must be interlocked, i.e., when one surface must touch the tip or outermost surface of an opposite serrated surface, damage to the sharp ends of the sawtooth or serrated edge surfaces will often occur. Such damage to the mechanism may interfere with the overall operation of the lift system and, as well, may give rise to a safety hazard in and of itself.

Problems of the above type have become particularly prevalent in automotive lift systems known as parallelogram systems, which are typically above-ground automotive hydraulic lifts. When damage occurs to the interlocking safety plates of such a system, the stability of, for example, a fifty ton truck resting upon a structure may be impaired. Also the truck may be left stuck in the air.

It is as a response to the above set forth needs of the prior art that the instant invention may be viewed.

SUMMARY OF THE INVENTION

The present invention relates to a safety system for use with an expansible hydraulic power element which is pivotally connected to a support leg and lift platform of an automotive vehicle lifting system. Provided between each support leg and corresponding vehicle platform is a first locking means having a first negative rake sinusoidal surface and, between each support leg and said platform, a second locking means having a negative rake sinusoidal surface complemental to said first sinusoidal surface. Said first and second surfaces are positioned for selectable slideable contact during emergency conditions that may occur as the legs and platform are elevated or lowered. The co-action between said first and second sinusoidal surfaces is advantageous in that said sinusoidal geometry, is not prone to breakage or chipping.

It is accordingly an object of the present invention to provide a safety interlock system for use with an expansible hydraulic power element.

It is another object of the invention to provide a system of the above type adapted for use in connection with an automotive hydraulic lift system.

It is a further object of the invention to furnish a system of the above type in which the hydraulic action of elevation or descent may be interrupted by a safety interlock between the elements.

It is a still further object of the present invention to provide a safety interlock system of the above type having enhanced durability and safety over prior art interlock systems.

The above and yet other objects of the present invention will become apparent from the hereinafter set forth Brief Description of the Drawings, Detailed Description of the Invention, and Claims appended herewith.

DETAILED DESCRIPTION OF THE INVENTION

Figure 1:
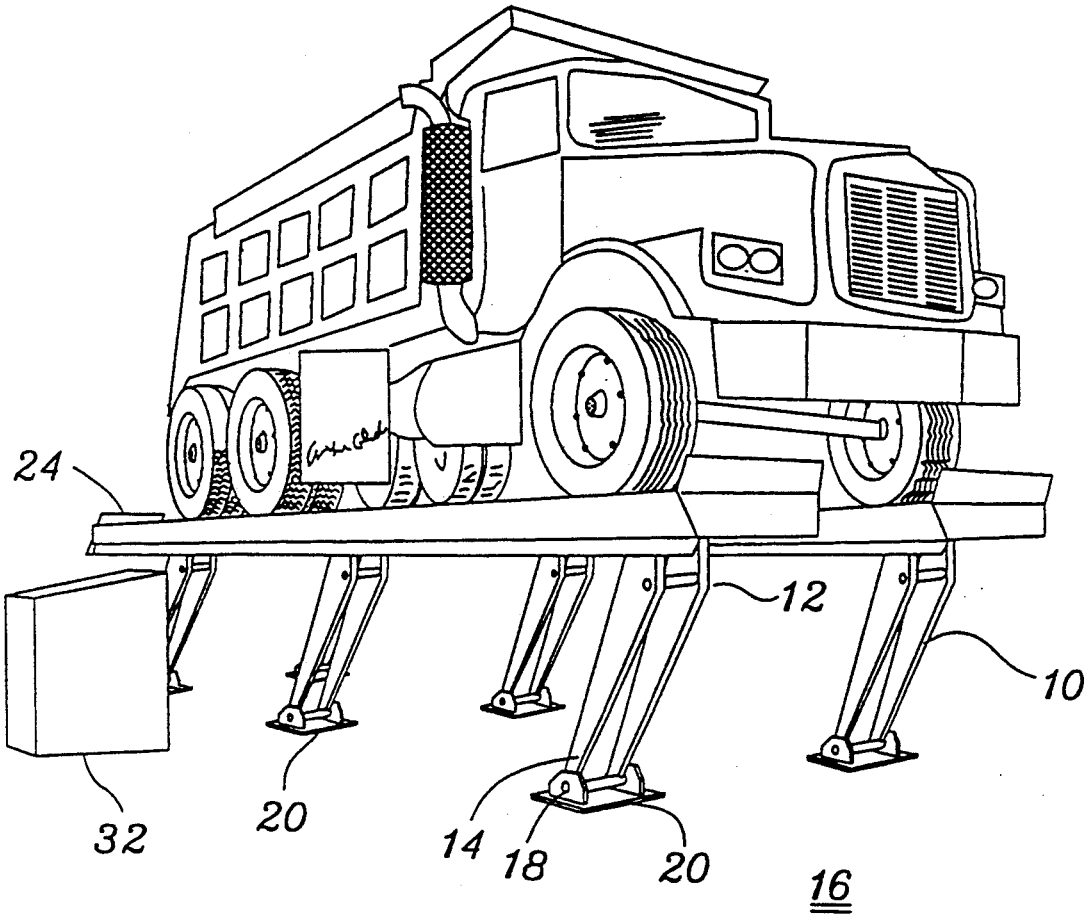
FIG. 1 is a perspective view showing an automotive lift system of the type with which the present inventive safety system is employed.

With reference to the perspective view of FIG. 1, the environment in which the present inventive safety locking system is used is seen to include that of an automotive lift having legs 10, including tops 12 and bottoms 14 thereof, which are anchored upon a floor 16 through pivots point 18 to base elements 20. Further shown in FIG. 1 are wheel platforms 24 and a hydraulic controller 32.

Figure 2:
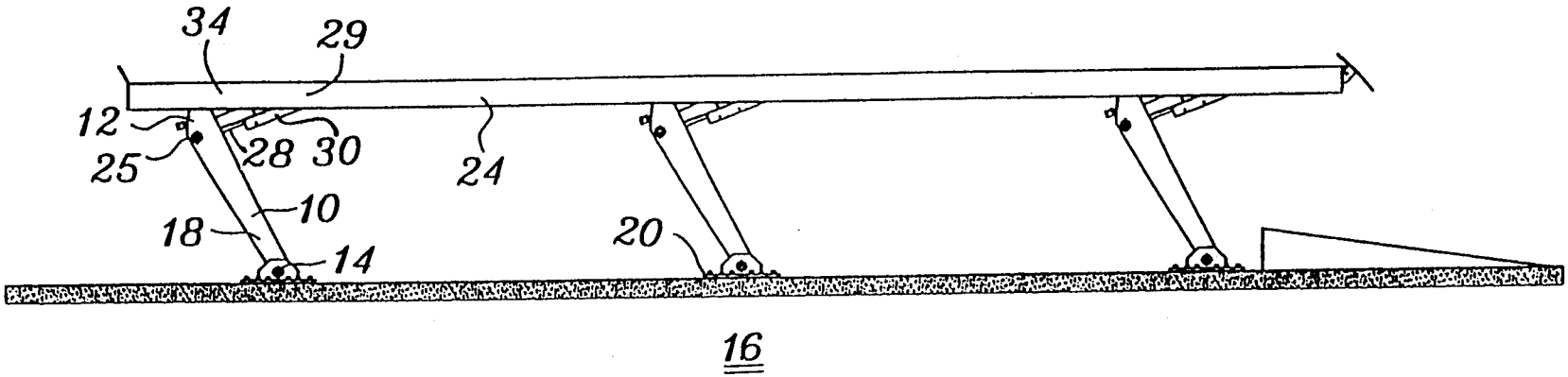
FIG. 2 is a side schematic view of the system of FIG. 1 without an automotive vehicle thereupon.

With reference to the view of FIG. 2, it is seen that tops 12 of legs 10 are rotationally mounted at pivot point 34 to platforms 24.

It is to be appreciated that the view of FIG. 2 represents the appearance and action of a representative lifting system when wheel platforms 24 are moving upwardly or downwardly.

Figure 3:
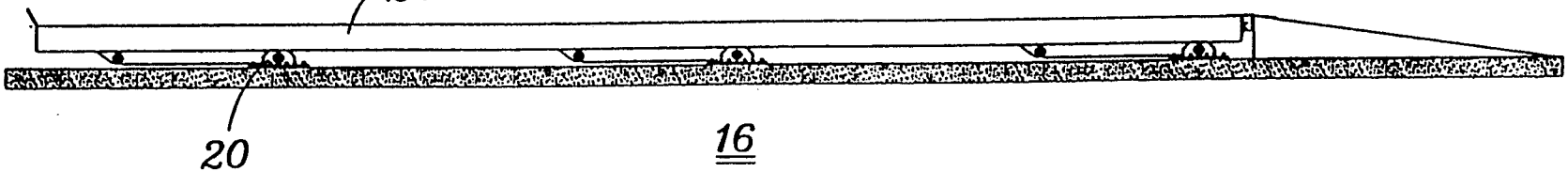
FIG. 3 is a view, similar to the view of FIG. 2, however, showing the system in a collapsed mode.

The collapsed condition of the assembly shown in FIGS. 1 and 2 is illustrated in FIG. 3.

Figure 4:
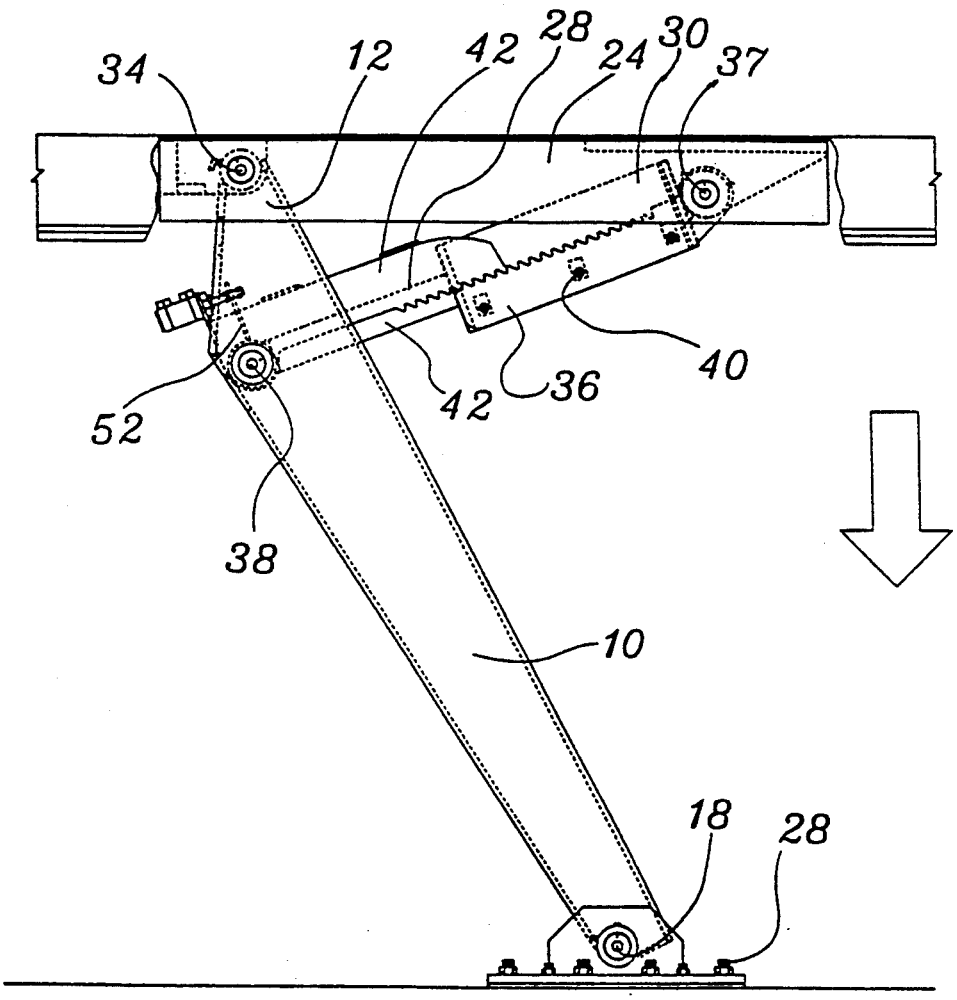
FIG. 4 is a detailed view of the inventive safety system in an extended mode.
Figure 6:
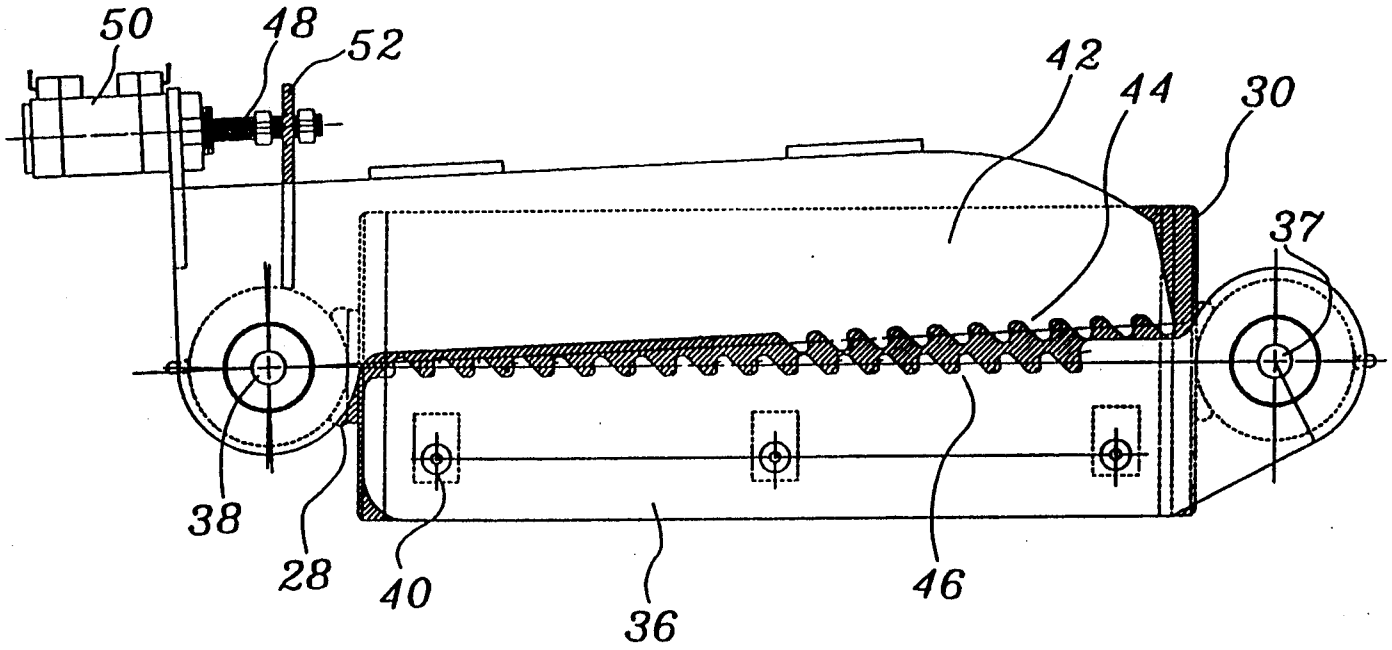
FIG. 6 is an enlarged view of FIG. 5 in which the configuration of the sinusoidal surfaces thereof is emphasized.

With reference to FIGS. 2, 4 and 6, it is to be appreciated that the lifting function is achieved through the co-action of hydraulic piston 28 and hydraulic cylinder 30. Upon each cylinder 30 is secured a lower locking means 36, having negative sinusoidal rake surfaces 46, which is held to the cylinder by screws 40. Over lower means 36 rests upper locking means 42 having negative rake sinusoidal surfaces 44 which surfaces are complemental to surfaces 46 of lower means 36. This occurs during ascent. That is during normal operation of ascent, surfaces 44 and 46 will slip over each other. However, during normal descent, upper means 42 is kept above the lowers means by member 52 (later described).

When an operator wishes to stop the descent of platforms 24, use is made of the present inventive locking system. More particularly, when the operator wishes to stop platform 24, upper means 42 is rotated downwardly about pivot point 38 by release of armature 48 of pneumatic piston 50. This causes member 52 to rotate to the right to bring upper locking means 42 into an interlock with the lower means 36. Accordingly, in such a position, the negative rake sinusoidal teeth 44 of upper interlock element 42 will mesh with the sinusoidal teeth 46 of lower means 36 in a fashion that will not damage the teeth.

During ascent, teeth 44 and 46 will self-lock by the action of gravity if the lifting motion of piston 28 stops.

The above system of facilitating an emergency stop of platforms carrying heavy automotive loads, often on the order of 50 tons, has been found to be superior to prior art efforts in which, as noted in the Background of the Invention, were limited value because of the use of serrated or jagged surfaces.

Figure 7:
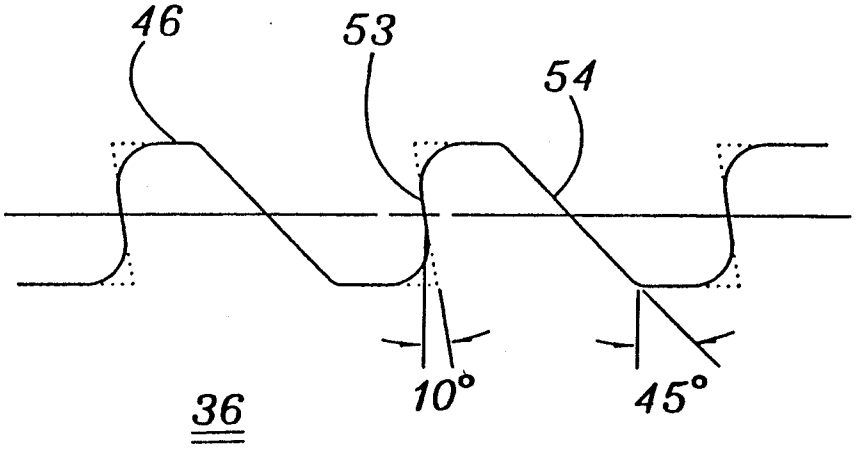
FIG. 7 is an enlarged view of the sinusoidal surfaces of FIG. 6 showing the relative angulation of the left and right sides of the interlocking surfaces.

In the inventive interlock system the geometry of teeth 44 and 46 is essentially that of a negative rake sinusoid (see enlarged view of FIG. 7), "negative" meaning tilted to the left when viewed from the perspective of teeth 46 of lower means 36. It has been found that most desirable function of this configuration is achieved when left edge 53 of teeth 46 is pitched at a ten degree angle and when right edge 54 of teeth 46 is pitched at a forty-five degree angle. The pitching provides the benefit of prior art sharp tooth configurations without the safety or maintenance problems associated therewith.

Figure 5:
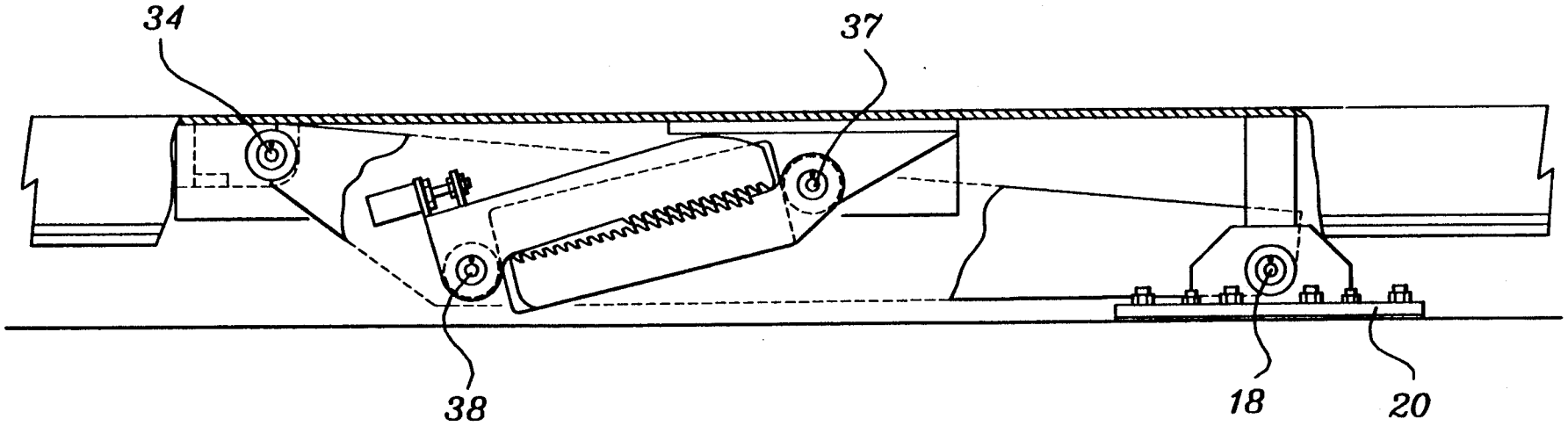
FIG. 5 is a view similar to FIG. 4, showing the safety system in a collapsed mode.

In view of FIG. 5, the system of FIG. 4 is shown in a completely collapsed position but prior to the return of interlock surfaces 42 and 36 to their positions during lifting or elevational mode. As such FIG. 5 corresponds to the view of FIG. 3.

While there has been shown and described the further embodiment of the present invention it is to be appreciated that the invention may be embodied otherwise than is here and specifically shown and described within said embodiment certain changes may be made within the form and arrangement of parts without departing from the underlying principles of this invention as set forth in the claims appended herewith.

We claim:

1. A safety system for use with an expansible hydraulic power element comprising a piston and cylinder, the piston pivotally connected to a support leg, of a vehicle lift system and such cylinder, pivotally connected to a lifting platform, the safety system comprising:

(a) lower locking means secured to a housing of said piston, said lower locking means having a continuous negative rake sinusoidal locking surface (NRSLS); and (b) upper locking means securable within the path of travel of said NRSLS of said lower locking means, said upper locking means having a continuous negative rake sinusoidal surface proportioned for selectable interlock with said NRSLS surface of said lower locking means.

2. The system as recited in claim 1, further comprising means for, during an emergency condition during platform descent, selectably placing said NRSLS of said upper locking means onto said NRSLS of said lower means.

3. The system as recited in claim 2 in which said upper locking means is pivotally connected to said support leg and in which said lower locking means is pivotably connected to said platform.

4. The system as recited in claim 3 in which surfaces of said lower means NRSLS nearest said support leg are pitched at an angle of about 10 degrees and in which opposite surfaces of teeth of said NRSLS of said upper means are pitched at an angle of about 45 degrees.

5. A safety system for effecting an emergency interlock of normally non-interlocking mechanical elements operating in slidable relationship to each other, comprising:

(a) first locking means, secured to a first of said mechanical elements, having a continuous negative rake sinusoidal locking surface (NRSLS); and (b) second locking means, secured to a second of said mechanical elements, having a continuous NRSLS proportioned for selectable interlock with said NRSLS of said first locking means responsive to an emergency-caused change in the normally non-interlocking relationship of said moveable elements.

6. The system as recited in claim 5, further comprising:

means for, during an emergency condition, biasing said NRSLS of said second locking means onto said NRSLS of said first locking means.

7. The system as recited in claim 6, in which said second locking means includes a pivotal connection to first support means and in which said first locking means includes a pivotal connection to a second support means.

8. The system as recited in claim 7, in which said first NRSLS of said first locking means nearest said first support surface comprises a pitch at an angle of about 10 degrees and in which an opposite surface of said NRSLS of said second locking means comprises a pitch at an angle of about 45 degrees.

* * * * *